US006216372B1

(12) United States Patent
Pehe

(10) Patent No.: US 6,216,372 B1
(45) Date of Patent: Apr. 17, 2001

(54) PROCESS FOR ATTACHING POSTERS OR RELATED ITEMS ONTO STRIP OF TRANSLUCENT MATERIAL

(76) Inventor: Willy Pehe, Refar 5, B-4970 Staveldt (BE)

( * ) Notice: Subject to any disclaimer, the term of this patent is extended or adjusted under 35 U.S.C. 154(b) by 0 days.

(21) Appl. No.: 09/186,834

(22) Filed: Nov. 5, 1998

(30) Foreign Application Priority Data

Nov. 9, 1997 (DE) ..... 197 49 438

(51) Int. Cl.[7] ..... G09F 11/18
(52) U.S. Cl. ..... 40/518; 40/571
(58) Field of Search ..... 40/361, 364, 471, 40/472, 518, 519, 520, 521, 522, 523, 524, 575, 576, 347

(56) References Cited

U.S. PATENT DOCUMENTS 2,200,533 * 5/1940 Borregard ..... 40/472
5,353,534 * 10/1994 Fassauer et al. ..... 40/524
5,598,651 * 2/1997 Aiken et al. ..... 40/518
5,809,677 * 9/1998 Wamser et al. ..... 40/471
5,953,840 * 9/1999 Simson et al. ..... 40/518 X

* cited by examiner

*Primary Examiner*—Brian K. Green
(74) *Attorney, Agent, or Firm*—Connolly Bove Lodge and Hutz LLP

(57) ABSTRACT

A process for attaching posters or related items onto an illuminated carrier film of translucent material, which runs from one reel to another and back again, provides for elimination of a light beam between adjacent posters. In this process an individual poster is flexibly secured to the carrier film at the edges of the poster, and the edges of two adjacent posters are positioned in pockets. The pockets are formed by two tongues of a translucent guide fixed to the carrier film of translucent material and extending perpendicular to the reel direction. One poster (10L) is fed into a first pocket (19) bordered by the carrier film (2) and a first tongue (15), and the other poster (10R) is fed into a second pocket (18) which is bordered by the first tongue (15) and a second tongue (17) connected to the first tongue and positioned away from the first pocket (19). This is done in such a way that the edge areas of the posters (10L, 10R) overlap one another in the pockets.

5 Claims, 1 Drawing Sheet

PROCESS FOR ATTACHING POSTERS OR RELATED ITEMS ONTO STRIP OF TRANSLUCENT MATERIAL

BACKGROUND OF THE INVENTION

The present invention relates to a process for attaching posters or related items onto an illuminated carrier film of translucent material, which runs from one reel to another and back again. In this process the individual poster is flexibly secured to the carrier film at its extending edges, perpendicular to the roller direction of the carrier film, and the edges of two adjacent posters are positioned in pockets. The pockets are formed by tongues of a translucent guide, secured in fixed position to the carrier film.

With the related process described in EP 0 333 820 B, individual adjacent posters mounted on the carrier film alternate, and a vertical light beam in the visual range of the graphics occurs between two adjacent posters on the carrier film. In some circumstances, the fluorescent tubes behind the transparent carrier film are visible; this can be distracting to those facing the advertising posters.

SUMMARY OF THE INVENTION

One of the objects of the present invention is a process related to the above-mentioned technology but which totally eliminates such light beams between adjacent posters.

In accordance with the present invention, the side edge of one poster is inserted into a pocket bordered by the carrier film and a first tongue, and a second poster is inserted into a second pocket bordered by the first tongue and a second tongue attached to the first one. This allows the edges of the posters to overlap one another in the pockets. The second pocket is situated in front of the first one.

With this arrangement, occurrence of a light beam in the graphic's visual range during review of a series of posters is eliminated. This makes it possible that with overlapping posters there would not only be no light beams with regard to the posters, but there would even be a darker stripe between adjacent Posters. Observers would not find this distracting. The overlapping areas can be printed in such a way that no light penetration occurs.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
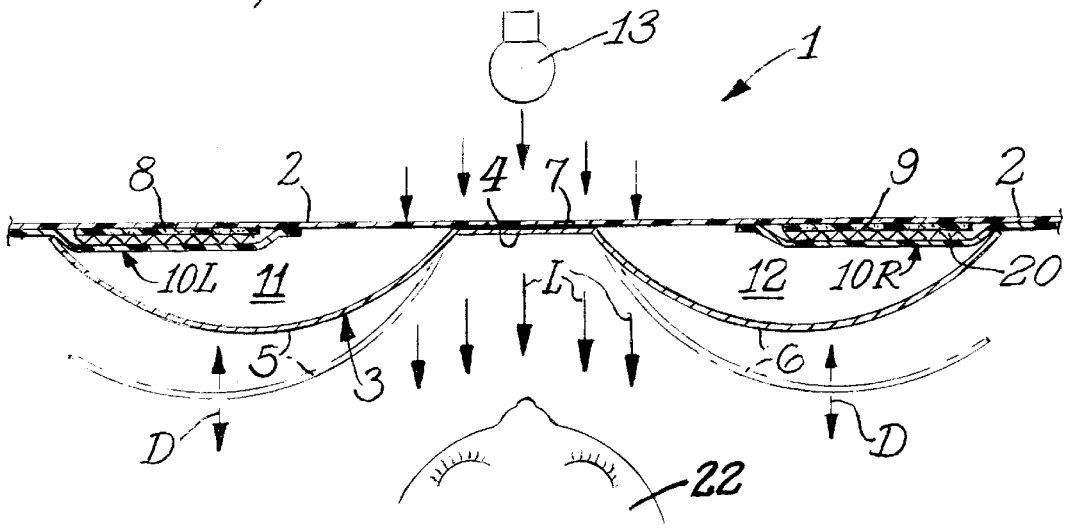
Fig. 1 (Prior Art)
FIG. 1 is a diagrammatic sectional top plan view of apparatus for attaching posters or related items onto a carrier film of translucent material, according to the prior art.

Referring in more particularity to the drawings, FIG. 1 shows the prior art which comprises a poster alternating display system 1 with a guide 3 mounted on a carrier film 2 made of translucent material. The guide 3 is permanently mounted to the carrier film 2. The guide component 3 consists of a connecting area 4 secured to the carrier film by adhesive 7, and two surrounding convex shaped tongues 5, 6 extending to the right and left, as shown in FIG. 1. The tongues are constructed as a single piece with the connecting area 4 between them. The guide is preferably made of a similar translucent material as the carrier film 2 and is permanently fixed by adhesive 7 at the connecting area 4 of the guide 3.

In the area covered by the convex tongues 5, 6, two translucent strips 8, 9 are permanently mounted on the side of carrier film 2 facing the tongues, along the length of each translucent strip. Each translucent strip runs from the top of the carrier film to the bottom thereof. Two posters 10L, 10R are flexibly fastened (i.e. floating) on the translucent strips 8, 9 and they can be removed. This guarantees easy movement of the individual posters when the carrier film is scrolling back and forth due to the springiness of the tongues 5, 6. The guide 3 is permanently mounted on carrier film 2 between the translucent strips 8, 9.

As shown in FIG. 1, the free side edges of the posters 10L, 10R do not reach the bottom of pockets 11, 12 formed by carrier film 2 and tongues 5, 6. This allows a limited shift of the posters in the pockets as the carrier film scrolls back and forth. The double arrow (D) associated with each tongue indicates that the tongues can float on the overlapped posters.

In use, the tongues 5, 6 are moved away from the carrier film 2 and the posters 10L, 10R are fixed to the translucent strips 8, 9 by removable double stick tape 20. Sections of double stick tape 20 may be applied at the top and bottom of the translucent strips 8, 9, or at the middle, depending on the various sizes of the posters. When released, the tongues 5, 6 spring back against the edge of the posters. With the posters spaced apart in this manner light L from source 13 passes through the carrier film 2 in the area between the posters which creates a visual distraction to the viewer 22.

In operation of the poster alternating system 1, the carrier film 2 and the posters on the film are illuminated from behind by a plurality of light sources, such as fluorescent tubes 13. If the carrier film is moved to display an adjacent poster, e.g., to the left in FIG. 1, the connecting area 4 also runs through the visual area. Since carrier film 2, the guide 3, and the connecting area 4 are transparent or milky, light exits between two spaced posters, as indicated by arrow L.

Figure 2:
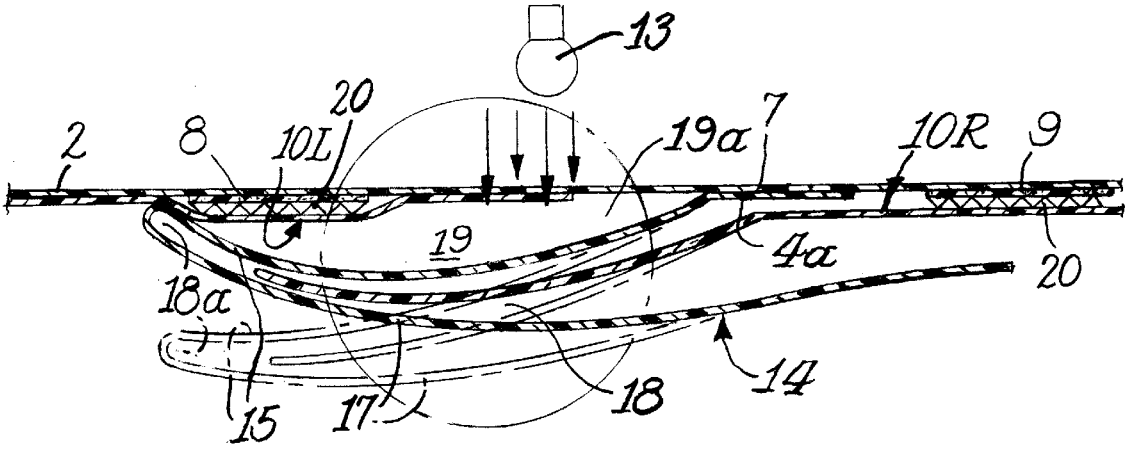
FIG. 2 is a diagrammatic sectional top plan view of apparatus for attaching posters or related items onto a carrier film of translucent material, according to the present invention.

FIG. 2 illustrates the present invention wherein a guide 14 has a tongue 15 corresponding to tongue 5 of guide 3. Tongue 15 overlaps the edges of poster 10L as described above and covers it and holds it securely on the carrier film 2 as it moves from right to left and vice versa. The width of tongue 15 is somewhat larger in order to allow a shift of the connecting area 4a to the right in FIG. 2, i.e, the connecting area of the guide is no longer located on the axis between translucent strips 8, 9. Tongue 15 is fixed to the carrier film by adhesive 7 at area 4*a* onto carrier film 2.

A convex tongue 17 adjoins the free edge of tongue 15. In FIG. 2, tongue 17 extends to the right, i.e., in the direction of the connecting area 4*a* and the translucent strip 9.

This leads to the development of a take-up pocket 18 for poster 10R which is located in front of the pocket 19 between tongue 15 and the tongue 17. The right side edge of poster 10L is fed into pocket 19 and the left side edge of poster 10R is fed into pocket 18 until the posters edges overlap one another. In the area of overlap the posters are preferably printed in such a way that they not only reduces light penetration, but in combination with one another they also prevent a disturbing light penetration. Either the print on the edge of one poster is enough to prevent light penetration or the print on the edges of both posters is sufficient to prevent light penetration. The insertion sequence of posters 10R and 10L into their respective pockets is random. The posters are not to be fed into the bottom 18*a* or 19*a* of the pockets, since otherwise the limited movement of in the pockets would be impeded.

Posters 10L, 10R may measure various sizes in the side-to-side direction with the overlapping adjacent side edges measuring about 2" to 5". The posters are held against the carrier film 2 by the double stick tape 20 on the translucent strips 8, 9, and the tongues 15, 17. Also, static charges between the carrier film and the posters hold the posters against the film.

Figure 3:
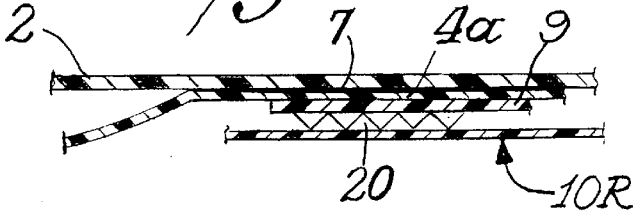
FIG. 3 is a partial diagrammatic sectional top plan view showing an alternative embodiment of the present invention.

In FIG. 3, the connecting area 4*a* of tongue 15 extends further to the right, and the translucent strip 9 is secured by adhesive 7 to the area 4*a*. Double stick tape 20 is secured to the exterior of translucent strip 9.

What is claimed is:

1. A process for attaching posters onto a carrier film of translucent material, which runs from one reel to another and back again, wherein adjacent posters are flexibly secured onto the carrier film along side edge portions of the posters, positioning a side edge portion of one poster into a first pocket formed by two tongues of a translucent guide secured to the carrier film, positioning a side edge portion of an adjacent poster into a second pocket formed by the carrier film and one of the two tongues, locating the tongues in front of the carrier film in overlapping relationship with one another whereby the side edge portions of the posters in the first and second pockets also overlap one another.

2. A poster alternating display system comprising a continuous translucent carrier film, at least one extending guide consisting of a connecting area secured to the carrier film, a first tongue extending from an edge of the connecting area, and a second tongue extending from an end of the first tongue in the direction of the connecting area, and least two adjacent posters each having opposite side edge portions, one side edge portion of one poster positioned between the first and second tongues and one side edge portion of an adjacent poster positioned between the carrier film and the first tongue.

3. A poster alternating display system as in claim 2 wherein each extending guide is a one-piece construction.

4. A poster alternating display system as in claim 3 wherein the first and second tongues are convex.

5. A poster alternating display system as in claim 2 wherein the first and second tongues define a first pocket and the first tongue and carrier film define a second pocket, and wherein the pockets overlap one another.

* * * * *

UNITED STATES PATENT AND TRADEMARK OFFICE

CERTIFICATE OF CORRECTION

PATENT NO. : 6,216,372 B1
DATED : April 17, 2001
INVENTOR(S) : Willy Pehe

It is certified that error appears in the above-identified patent and that said Letters Patent is hereby corrected as shown below:

Claims,
Column 4,
Line 12, after the word "and", insert -- at --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*